United States Patent [19]

Steinhauser

[11] Patent Number: 4,716,663

[45] Date of Patent: Jan. 5, 1988

[54] CLIMBING SHOE

[76] Inventor: Oli Steinhauser, 79 Rockinghorse Rd., Rancho Palos Verdes, Calif. 90274

[21] Appl. No.: 38,044

[22] Filed: Apr. 14, 1987

[51] Int. Cl.[4] ..... A43C 15/00

[52] U.S. Cl. ..... 36/113; 36/114

[58] Field of Search ..... 36/84, 45, 77 R, 77 M, 36/59 R, 113, 114, 59 C

[56] References Cited

U.S. PATENT DOCUMENTS 2,772,489 12/1956 Porter ..... 36/45

3,191,321 6/1965 Brutting ..... 36/59 R

FOREIGN PATENT DOCUMENTS 908400 4/1946 France ..... 36/114

39362 9/1985 Japan ..... 36/114

*Primary Examiner*—Donald Watkins

*Attorney, Agent, or Firm*—Allen A. Dicke, Jr.

[57] ABSTRACT

The climbing shoe is covered with thin, flexible, high-friction rubberlike material on the outside of the shoe from the area of contact of the ball of the foot forward to the toe all the way up to the midline of the shoe. This comprises an engagement surface so that the shoe can be turned and the toe inserted into a crevice with the engagement surface against one wall of the crevice to enhance traction and protect the shoe upper.

16 Claims, 4 Drawing Figures

CLIMBING SHOE

FIELD OF THE INVENTION

This invention is directed to a climbing shoe for rock climbing which has an engagement surface on the forward inner and/or outer part of the shoe up to the shoe mid-line for enhance grip in a crevice.

BACKGROUND OF THE INVENTION

Rock climbers must feel the surfaces against which their feet engage. Therefore, climbing shoes are lightweight, uncushioned, thin-soled, extremely flexible, and tight-fitting. The soles are smooth and thin and are formed of a high-friction rubberlike material. The welt is of the same material as the sole, and in a climbing shoe extends about ¾ inch up from the sole, all the way around the shoe. The climbing shoe upon which this sole and welt is formed is a canvas shoe trimmed with leather. Thus, the shoe upper is unprotected from abrasion and has low friction value. It is desirable to enhance the engagement characteristics of the shoe by applying additional high-friction material to those areas which may be employed in climbing.

SUMMARY OF THE INVENTION

In order to aid in the understanding of this invention, it can be stated in essentially summary form that it is directed to a climbing shoe. The climbing shoe has a thin, flexible high-friction material applied as an engagement surface on the forward upper portion of the shoe from the welt to the locking edge of the shoe on the left, right or both sides so that the user may turn his toe, insert it into a crevice and engage the rock with this engagement surface.

It is an object and advantage of this invention to provide a climbing shoe which has enhanced engagement surface for enhanced climbing capability so that the climber has greater security and greater capability.

It is another object and advantage of this invention to provide a climbing shoe which is light, flexible, close-fitting in which enhanced engagement surface permits the climber to climb more safely and engage in crevices which did not previously admit such engagement.

Other purposes and advantages of this invention will become apparent from a study of the following portion of the specification, the claims and the attached drawings.

DESCRIPTION OF THE PREFERRED EMBODIMENTS

Figure 1:
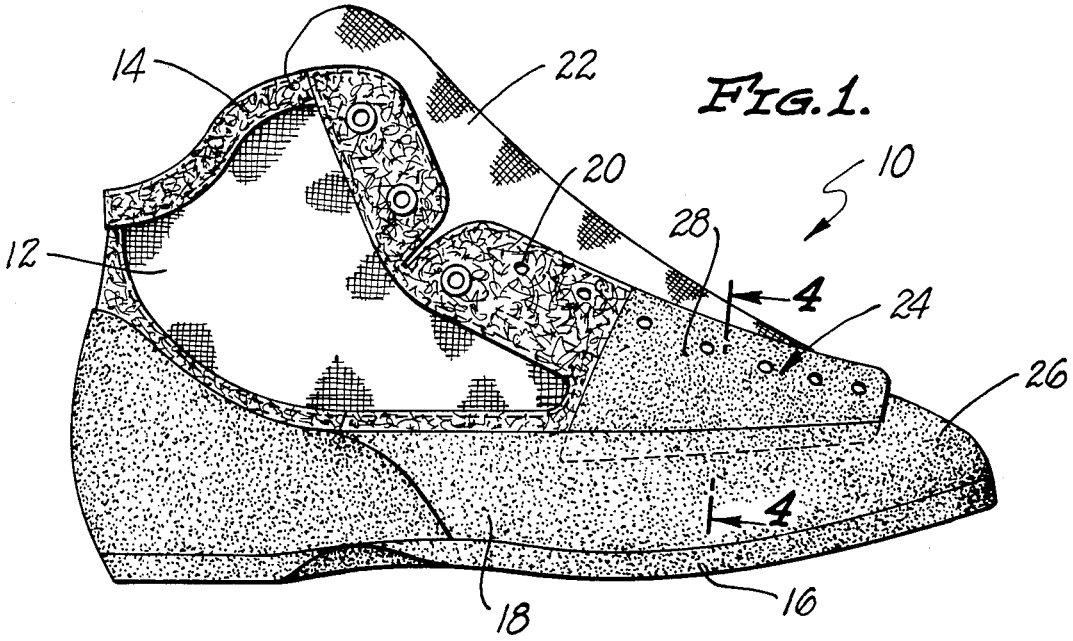
FIG. 1 is a right side-elevational view of a climbing shoe in accordance with this invention for the right foot, without laces.
Figure 2:
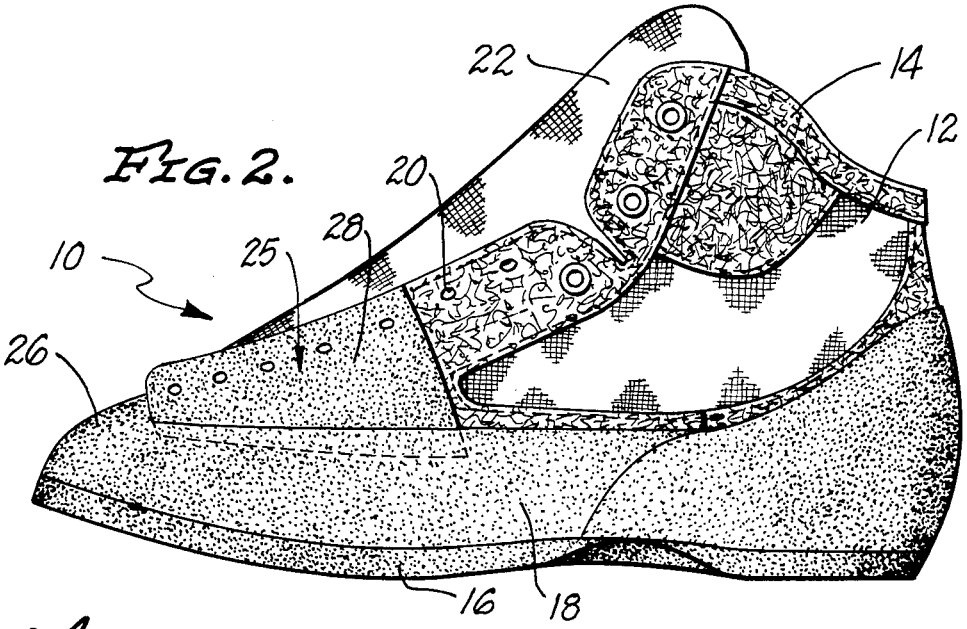
FIG. 2 is a left side-elevational view thereof.

The climbing shoe 10 of this invention is shown in right side elevation for a shoe for the right foot in FIG. 1 and is shown in left side elevation for the same shoe in FIG. 2. Shoe 10 has a canvas upper 12 with leather trimming 14 around the ankle and lacing openings of the shoe. Alternatively, the shoe upper may be all leather. The shoe has a sole 16 together with welt 18. The welt extends partway up the sides of the shoe upper. The sole and welt are formed of a thin, flexible, high-friction, rubberlike material. The shoe 10 is designed with as little material as possible between the foot of the wearer and the outside of the shoe so that the climber can have maximum tactile sense of the surface to which he applies the shoe. Further, the shoe 10 is close-fitting to provide for this tactile connection. From the ankle opening forward, the shoe is open over the arch substantially along its top medial center line and is provided with lacing openings 20 along lacing edges for the employment of laces to close the shoe and tighten the shoe upon the climber's foot. A tongue 22 is provided to close the shoe between the lacing edges and protect the foot from the laces.

Figure 4:
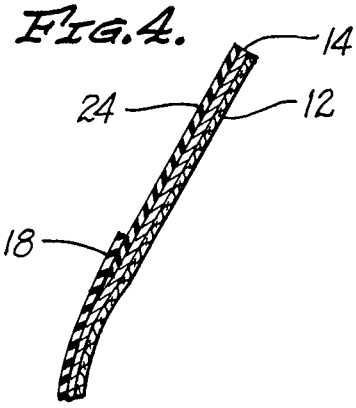
FIG. 4 is an enlarged section taken generally along line 4—4 of FIG. 1.
Figure 3:
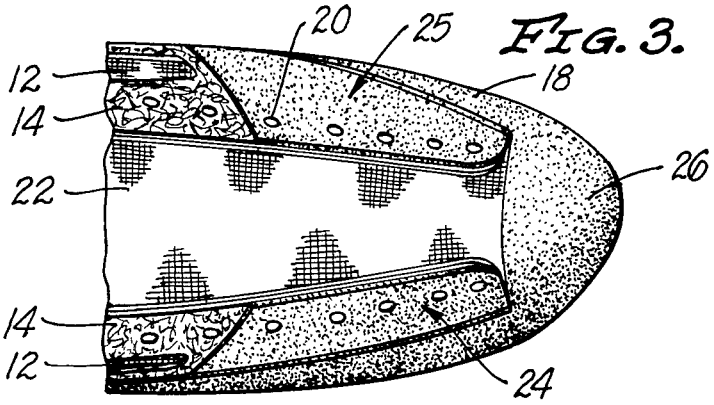
FIG. 3 is a plan view of the toe portion thereof, with parts broken away.

In accordance with this invention, engagement material 24 is provided on the upper outer forward portion of the shoe to provide an engagement surface which extends from the top of the welt to the lacing edge about halfway forward along the length of the shoe or from about the point in the shoe for engagement by the ball of the foot forward to the toe cap 26 which forms part of the welt 18. The engagement material 24 is of the same class of material as the sole and the welt; that is, a thin, flexible, high-friction, rubberlike material. As is preferably the same material as is shown in FIGS. 1 and 4, the welt is lapped over the engagement material to provide a continuous engagement surface on the forward upper outer portion of the shoe from the sole up around to the lacing edge, which extends as close to the mid-line as any portion of the upper of the shoe. The inside corresponding forward portion of the shoe may also or alternatively be provided with a panel of the same engagement material as indicated at 25 in FIGS. 2 and 3. The engagement material is permanently attached in place as by adhesive attachment by which the material is permanently molded into place. The right shoe is shown, and the left shoe is identical. It has an engagement surface on the upper forward inner and outer side of the shoe from underlapping the welt to the lacing edge. Only one of such panels may be employed. On the left shoe, the engagement material also extends from a point about halfway forward in the shoe from approximately where the ball of the foot engages in the shoe, all the way to the toe cap so that the upper inner and outer forward portions of the shoe are continuously covered with engagement material to provide a continuous engagement surface from the sole to the lacing edge, and on the forward half of the shoe.

In use, the climber wears his shoes during climbing of a rock face. When he reaches a generally upwardly directly crevice, he can turn his foot and apply it edgewise into the crevice to engage the toe and forward part of the shoe in the crevice. If the crevice is the right width, the forward part of the shoe can be wedged therein, with the sole engaging one side and the engagement surface 28 of the engagement material engaging the other side of the crevice. The engagement material prevents damage to that portion of the upper, which would otherwise be exposed, and increases the frictional engagement of the shoe within the crevice. Such insertion of the shoe into a crevice works for any angle of crevice, from horizontal to vertical, and it is mostly a question of crevice angle as to choice of which shoe will be turned which way to be engaged therein. In this way, engagement is enhanced and the shoe is protected.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A climbing shoe comprising:

a shoe upper formed of non-friction material, said shoe upper having a medial center line and having lacing edges facing said medial center line, said shoe being one of a pair of shoes for human wear, said shoe having an inside facing the inside of the other shoe of the pair of shoes and an outside facing away from the other shoe of the pair of shoes when the pair of shoes is positioned for wearing;

a sole and a welt joining said upper and extending partway up said upper to leave a portion of said non-friction material exposed, said sole and said upper being made of thin, flexible, rubberlike, high-friction material; and an engagement panel positioned and secured to said upper on the forward portion of said upper extending from said welt to said lacing edge on at least one of said inside and outside of said shoe.

2. The climbing shoe of claim 1 wherein said engagement panel is made of thin, flexible, high-friction, rubberlike material.

3. The climbing shoe of claim 2 wherein said engagement panel laps with said welt.

4. The climbing shoe of claim 3 wherein said welt overlaps said engagement panel.

5. The climbing shoe of claim 4 wherein said engagement panel extends from a position substantially as far forward on said upper as the location of engagement of the ball of the climber's foot within said shoe and said engagement panel extends to said lacing edge.

6. The climbing shoe of claim 5 wherein said welt forms a toe cap and said engagement panel extends forward to said to cap so that the outer side of said shoe is protected with welt or engagement material from the toe of said shoe up to said lacing edge of said shoe and substantially back to the point of engagement within said shoe of the ball of the climber's foot.

7. The climbing shoe of claim 1 wherein said engagement panel extends from a position substantially far forward on said upper and said engagement panel extends to said lacing edge.

8. The climbing shoe of claim 7 wherein said welt forms a toe cap and said engagement panel extends forward to said to cap so that the inner and/or outer side of said shoe is protected with welt or engagement material from the toe of said shoe up to said lacing edge of said shoe and substantially back to the point of engagement within said shoe of the ball of the climber's foot.

9. The climbing shoe of claim 1 wherein said engagement panel laps with said welt.

10. The climbing shoe of claim 9 wherein said welt overlaps said engagement panel.

11. A climbing shoe comprising:

a shoe upper with a sole thereunder and a welt attached to said sole and engaging partway up said upper from said sole, said sole and said welt being made of a thin, flexible, rubberlike, high-friction material, said shoe having a pair of facing lacing edges above said welt, said shoe having and outside and an inside; and an engagement panel of thin, flexible, rubberlike, high-friction material extending from said welt substantially to said lacing edge on the forward, outside portion of said shoe.

12. The climbing shoe of claim 11 wherein said engagement panel is made of substantially the same material as said welt.

13. The climbing shoe of claim 11 wherein said engagement panel extends from a point forward in said shoe substantially as far forward in said shoe as the engagement point of the ball of a climber's foot in said shoe on the outside of said shoe.

14. The climbing shoe of claim 11 wherein said engagement panel extends all the way to said lacing edge on the outside of said shoe.

15. The climbing shoe of claim 14 wherein said engagement panel extends from a point about halfway forward on said shoe substantially as far forward in said shoe.

16. The climbing shoe of claim 15 wherein said engagement panel is made of substantially the same material as said welt.

* * * * *